US006343645B1

(12) United States Patent
Baumann et al.

(10) Patent No.: US 6,343,645 B1
(45) Date of Patent: Feb. 5, 2002

(54) MULTI-CHAMBER TUBE AND HEAT EXCHANGER ARRANGEMENT FOR A MOTOR VEHICLE

(75) Inventors: Rainer Baumann, Vaihingen/Enz; Jürgen Hägele; Volker Kurz, both of Stuttgart; Martin Rilk, Pforzheim; Erwin Skiba, Stuttgart, all of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/563,227

(22) Filed: May 2, 2000

(30) Foreign Application Priority Data

May 3, 1999 (DE) ..... 199 20 102

(51) Int. Cl.[7] ..... F28D 7/16; F28F 1/02
(52) U.S. Cl. ..... 165/140; 165/177
(58) Field of Search ..... 165/140, 177, 165/183, 176; 138/115

(56) References Cited

U.S. PATENT DOCUMENTS

| | | | | | |
|---|---|---|---|---|---|
| 2,051,110 | A | * | 8/1936 | Smith | 165/140 X |
| 2,521,040 | A | * | 9/1950 | Casetta | 165/140 X |
| 2,650,073 | A | * | 8/1953 | Holm | 165/140 |
| 2,653,014 | A | * | 9/1953 | Sniader | 165/140 |
| 5,009,262 | A | * | 4/1991 | Halstead et al. | 165/140 |
| 5,036,910 | A | * | 8/1991 | Wolf | 165/140 |
| 5,186,250 | A | * | 2/1993 | Ouchi et al. | 165/177 |
| 5,318,114 | A | * | 6/1994 | Sasaki | 165/177 X |
| 5,441,106 | A | * | 8/1995 | Yukitake | 165/183 |

FOREIGN PATENT DOCUMENTS

| | | | | |
|---|---|---|---|---|
| EP | 0 302 232 | | 2/1989 | |
| EP | 0 881 450 | | 12/1998 | |
| GB | 539970 | * | 9/1941 | 165/140 |
| GB | 598771 | * | 2/1948 | 165/140 |
| JP | 2-230091 | * | 9/1990 | 165/183 |
| JP | 4-254170 | * | 9/1992 | |

* cited by examiner

*Primary Examiner*—Leonard Leo
(74) *Attorney, Agent, or Firm*—Crowell & Moring, LLP

(57) ABSTRACT

A multi-chamber tube for a heat exchanger arrangement of a motor vehicle has at least two chamber sections which extend parallel to each other and side-by-side. Different liquid or gaseous heat transfer media are used in the chamber sections which have widths significantly greater than their heights. At least one chamber section has a greater height than at least one other chamber section. The multi-chamber tube is used in a coolant radiator and charge air cooler combination.

17 Claims, 8 Drawing Sheets

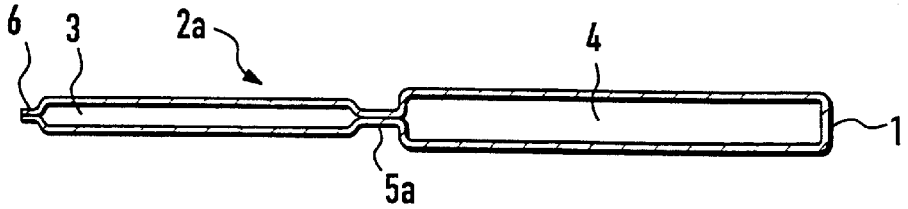
FIG. 1a
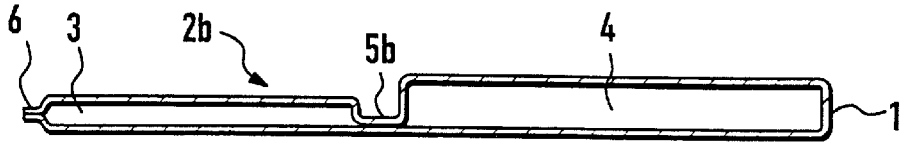
FIG. 1b
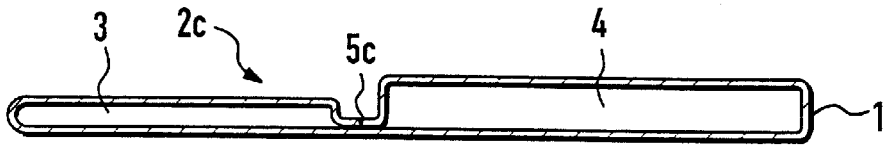
FIG. 1c
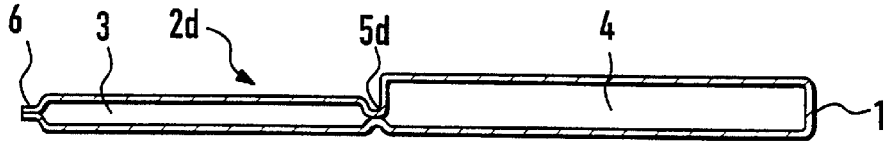
FIG. 1d
FIG. 1e
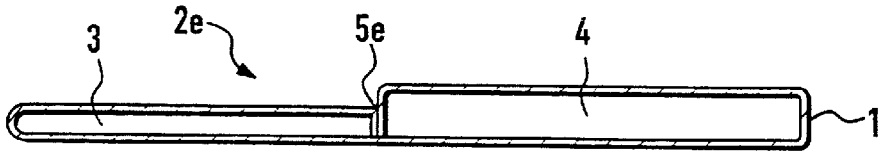

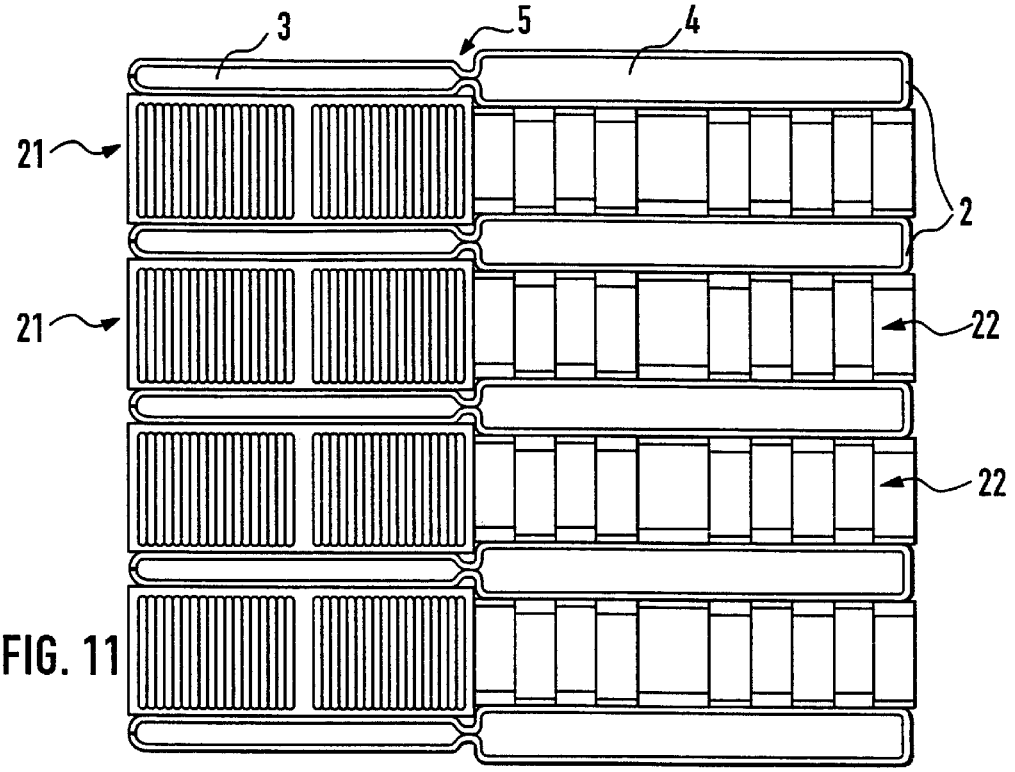
FIG. 11
FIG. 12
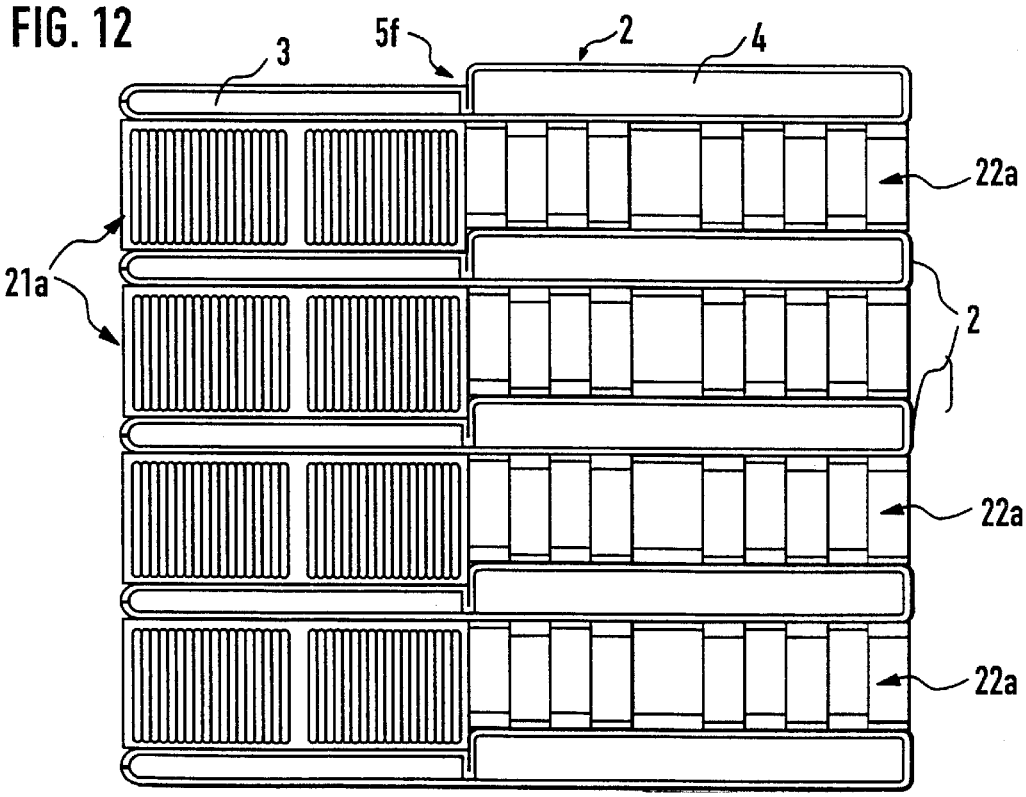

MULTI-CHAMBER TUBE AND HEAT EXCHANGER ARRANGEMENT FOR A MOTOR VEHICLE

This application claims the priority of German application 199 20 102.1, filed May 3, 1999, the disclosure of which is expressly incorporated by reference herein.

BACKGROUND AND SUMMARY OF THE INVENTION

The present invention relates to a multi-chamber tube for a heat exchanger arrangement of a motor vehicle having at least two chamber sections. The chamber sections extend in parallel side-by-side, have widths which are significantly greater than their heights, and are used for different liquid or gaseous heat transfer media. The invention also relates to a heat exchanger arrangement for a motor vehicle having at least two heat exchangers and a common fin/tube block with a plurality of multi-chamber tubes as well as a plurality of fin arrangements.

European Patent Document EP 0 881 450 A1 relates to a heat exchanger arrangement for a motor vehicle which is known and which consists of two heat exchangers. The two heat exchangers have a common fin/tube block which is composed of a plurality of two chamber tubes as well as of a plurality of corrugated fins situated between the tubes. The two-chamber tubes are designed as extruded light-metal profiles and are provided with two chamber sections which extend in parallel to one another and which are each assigned to one heat exchanger. In one chamber section, several ducts which extend parallel to one another are additionally integrated. As a result of this heat exchanger arrangement, it is possible to provide common multi-chamber tubes as well as common corrugated fins for the two heat exchangers. This reduces the manufacturing expenditures required for the heat exchanger arrangement.

It is an object of the invention to provide a multi-chamber tube as well as a heat exchanger arrangement of the initially mentioned type which can be used in a simple manner for different liquid and gaseous heat transfer media.

This object is achieved in the multi-chamber tube by the provision of at least one chamber section with a greater height than that of at least one other chamber section. As a result, the multi-chamber tube is particularly suitable for a use in a heat exchanger arrangement which is constructed as a combination of a charge air cooler and a coolant radiator. The chamber section with the greater height has an enlarged flow-through volume so that suitable gaseous media can be used in a simple manner for heat transfer.

As a further development of the multi-chamber tube, this multi-chamber tube is shaped from a metal sheet which is plated by brazing on both sides. The multi-chamber tube, therefore, is produced by forming a sheet metal band or a thin-walled sheet metal bar, with opposed lateral edges of the sheet metal band or of the plate-shaped or strip-shaped sheet metal bar designed to rest against one another or on other wall sections of the sheet metal band or of the sheet metal bar. Desired tight connections are produced by a subsequent brazing-together operation in a brazing furnace or by a welding-together operation.

In a still further development of the invention, several ducts, which extend parallel to one another, are integrated in at least one chamber section. As a result of subdivision of the chamber section into several ducts, it becomes possible to guide a corresponding heat transfer medium through under an increased pressure. This chamber section, therefore, is particularly suitable for use in a condenser.

The object mentioned above is also achieved in a heat exchanger arrangement by providing a plurality of such multi-chamber tubes with at least one chamber section having a greater height than at least one other chamber section. The heat exchanger arrangement can be used particularly advantageously as a combination of a charge air cooler and a coolant radiator.

As a further development of the heat exchanger arrangement, each fin arrangement is formed by a one-piece combination of corrugated fin sections and web fin sections. The solid fin sections, which have a design which is basically known, are particularly advantageous for a charge air cooler. The one-piece design of the fin arrangements ensures secure cohesion of the fin/tube block of the heat exchanger arrangement.

As a further development of the invention, the multi-chamber tubes lead on the front side into a flow tank unit which has a common bottom, which is continuous over the width of the multi-chamber tubes, and which is provided with passages adapted to the different cross-sections of the chamber sections. This structure is particularly easy to produce. The flow tank unit, the fin arrangements, and the multi-chamber tubes are preferably produced from a light-metal alloy, so that the heat exchanger arrangement has an all-metal construction. The individual parts are advantageously preassembled to form a unit and are brazed together with one another in a single operation in a brazing furnace.

As yet a further development of the invention, an individual surrounding passage, which is correspondingly adapted in its width to the height of the chamber sections, is assigned to each multi-chamber tube. As a result, only a single operation per multi-chamber tube is required for producing the respective passage. The passages are designed such that, after brazing to the multi-chamber tubes, they have a tight connection so that the flow tank unit is tightly closed off in the bottom area.

As an even further development of the invention, the flow tank unit, including the bottom and the separating wall, is produced in one piece, by forming, from an individual metal sheet blank. As a result, a particularly simple production method is achieved for the flow tank unit.

Additional advantages and characteristics of the invention are reflected in the claims and will be apparent from the following description of preferred embodiments of the invention which are illustrated in the drawings.

BRIEF DESCRIPTION OF THE DRAWINGS

FIGS. 1*a* to 1*i* are respective views of embodiments of a multi-chamber tube according to the invention which have different cross-sections;

FIG. 11 is a top view of a cutout of a fin/tube block of a heat exchanger arrangement formed of two heat exchangers; and FIG. 12 is a view of a cutout of a heat exchanger arrangement similar to FIG. 11.

DESCRIPTION OF THE PREFERRED EMBODIMENTS

Figure 1F:
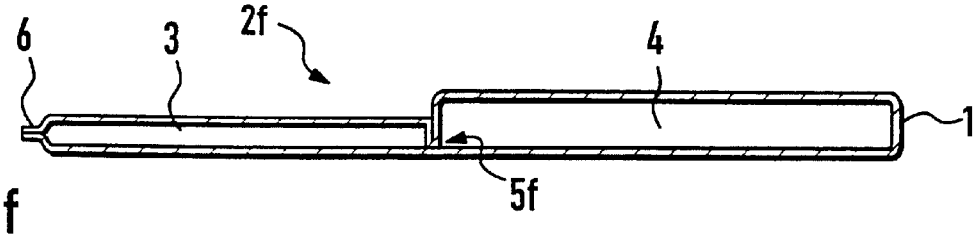

The multi-chamber tubes 2*a* to 2*h* illustrated in FIGS. 1*a* to 1*h* are provided for a heat exchanger arrangement of a motor vehicle. The arrangement is composed of two heat exchangers, preferably of a coolant/air radiator and a charge air/air cooler. Each multi-chamber tube 2*a* to 2*h* has two chamber sections 3, 4, each of which forms a continuous flow duct. One or several chamber sections can additionally be divided into several ducts which extend parallel to one another in a manner such as that shown in FIG. 1*i*. Each of the two chamber sections 3, 4 of the multi-chamber tubes 2*a* to 2*h* represents a flat-tube section, so that the width of each chamber section 3, 4 is significantly greater than the height of each chamber section 3, 4. The multi-chamber tubes 2*a* to 2*h* are all produced from a plane sheet metal band or a plane sheet metal bar by forming operations, such as bending and edging. The multi-chamber tubes 2*a* to 2*h* are all formed from metal sheets of a light metal alloy which are plated by brazing on both sides. The light-metal alloy is preferably an aluminum alloy. Each of the two chamber sections 3, 4 is separated from the other by tight separating sections 5*a* to 5*h*; each of these sections, as will be described in detail, has a different design. The tight connection of the sheet metal sections of the multi-chamber tubes 2*a* to 2*h*, which are disposed upon one another in a blunt or flat manner, is achieved by a material-locking connection in the form of a brazing or welding. The brazed connection preferably takes place in a single operation with the brazing-together of the whole heat exchanger arrangement in a brazing furnace, in which case the different parts of the heat exchanger arrangement are joined in a preassembled condition.

In the embodiment shown in FIG. 1*a*, the opposed lateral longitudinal edges of the sheet metal band are placed together in the area of a web flange 6 on an edge of the chamber section 3, which is on the left in the representation of FIG. 1*a*, and are tightly brazed together with one another. The separating section 5*a* of the multi-chamber tube 2*a* is created, by corresponding depressions from the top side as well as from the bottom side, so that a web-type flat connection is established. Also, in the case of the separating section 5*a*, the tight connection is established by a flat brazing together of the braze plated arrangements in the brazing furnace.

The multi-chamber tube 2*b* shown in FIG. 1*b* essentially corresponds to the multi-chamber tube 2*a* according to FIG. 1*a* with the difference that, unlike the multi-chamber tube 2*a*, the multi-chamber tube 2*b* is not designed mirror-symmetrically with respect to a longitudinal center plane. The multi-chamber tube 2*b* instead has a continuous planar side which, in the representation of FIG. 1*b*, is the bottom side. The top side has a depression in the area of the separating section 5*b* for creating the separating web.

All multi-chamber tubes 2*a* to 2*h* have in common that the chamber section 4 has a greater height and a greater width than the chamber section 3. The differences in the respective flow cross-sections, and thus in the heights of the two chamber sections 3, 4, are determined according to the respective usage.

In the embodiment shown in FIG. 1*c*, the multi-chamber tube 2*c* is formed such that the lateral longitudinal edges of the sheet metal band in the area of the separating section 5*c* are directly adjacently joined side-by-side. The two lateral edges of the sheet metal band adjoin one another in the area of their edges in an almost abutting manner and, by way of a corresponding angular bend, are placed flatly onto the lower wall section of the multi-chamber tube 2*c*.

In the embodiment shown in FIG. 1*d*, a lateral edge connection is selected in the area of the web flange 6, as disclosed in the embodiments according to FIGS. 1*a* and 1*b*. The separating section 5*d* is formed by depressions which are semicircular in their cross-sections and which are made from opposed sides.

The multi-chamber tube 2*e* shown in FIG. 1*e* has lateral edges of the sheet metal band which, similar to FIG. 1*c*, are also joined in the area of the separating section 5*e*. In this case, the opposed lateral edges are, in each case, bent away toward the inside at a right angle and adjoin one another flush by way of their adjacent front faces. The front edges situated on the bottom rest in a blunt manner on the lower interior wall of the multi-chamber tube 2*e*.

The multi-chamber tube 2*f* has fold-type creased longitudinal edges which are joined in the area of the web flange 6. The separating section 5*f* is formed by a fold which is disposed at a right angle on the lower wall section of the multi-chamber tube 2*f*. Like the embodiments according to FIGS. 1*b* to 1*e*, the multi-chamber tube 2*f* is also designed asymmetrically with respect to a longitudinal center plane.

Figure 1G:
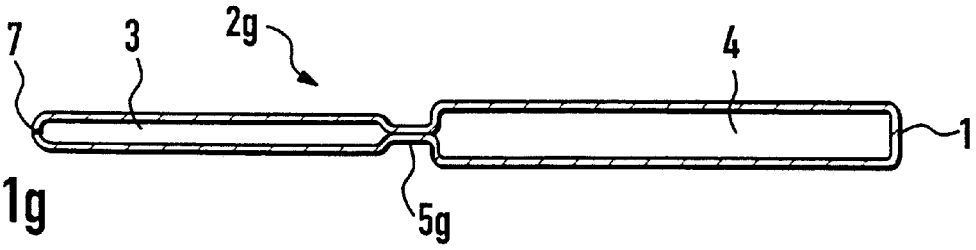

In a manner similar to the multi-chamber tube 2*a* according to FIG. 1*a*, the multi-chamber tube 2*g* shown in FIG. 1*g* is designed symmetrically with respect to a longitudinal center plane and has a separating section 5*g* which corresponds to the separating section 5*a* according to FIG. 1*a*. In the area of the outer lateral edge of the chamber section 3, the lateral longitudinal edges in the area of an outer seam 7 are placed bluntly on one another and are continuously tightly welded to one another. Laser welding is preferably provided.

Figure 1H:
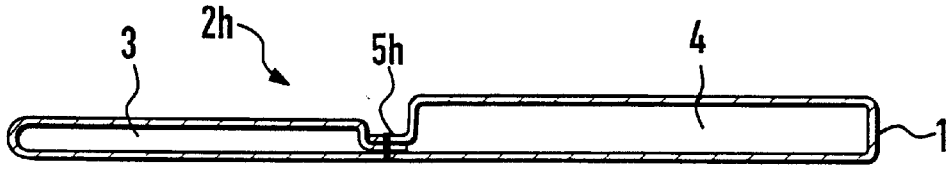
Figure 1I:
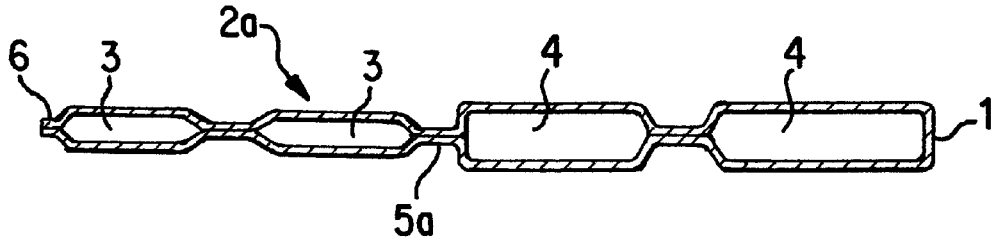

In the embodiment of FIG. 1*h*, the lateral longitudinal edges of the sheet metal band in the area of the separating section 5*h* are placed on one another in an overlapping fashion and are continuously welded together jointly with the lower wall section. Here also, the welded connection is preferably made by laser welding.

Figure 2:
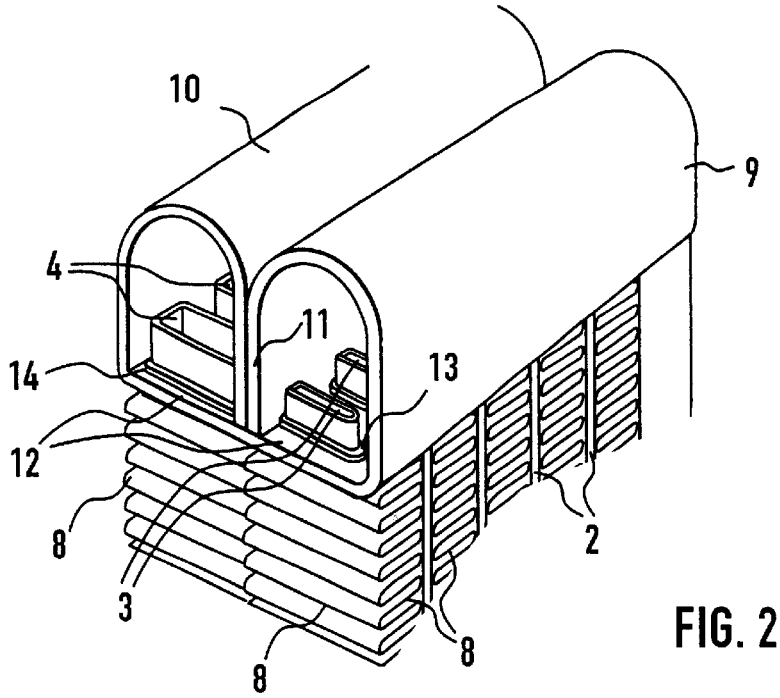
FIG. 2 is a perspective, partially cut-away view of an embodiment of the heat exchanger arrangement according to the invention.

Multi-chamber tubes 2 with two chamber sections 3, 4 of different sizes, as described in connection with the embodiments of FIGS. 1*a* to 1*h*, can be integrated in a heat exchanger arrangement shown in FIG. 2. The heat exchanger arrangement according to FIG. 2 represents a combination of two heat exchangers which are arranged behind one another in the air flow-through direction. Together with mutually separated corrugated fins 8, which are assigned separately to each chamber section 3, 4, the multi-chamber tubes 2 form a common fin/tube block of the heat exchanger arrangement. On the front side, each of the front ends of the chamber sections 3, 4 leads into a respective one of the flow tanks 9, 10, which are produced in one piece from a common metal sheet and form a joint flow tank unit. For this purpose, a joint bottom 12 is assigned to the two flow tanks 9, 10; this bottom 12 is provided with passages 13, 14 which are coordinated with the different outer contours of the chamber sections 3, 4. The metal sheet of the two flow tanks 9, 10 is formed with a B-shaped cross-section so that the corresponding wall sections in the area between the chamber sections 3, 4 form a continuous, double-wall separating area 11 which causes the division into the two flow tanks 9, 10.

Depending on the design of the heat exchanger arrangement, the opposite front side of the fin/tube block can also be provided with a correspondingly designed flow tank unit 9, 10. However, as an alternative, on the opposite side, simply designed flow deflections can also be achieved on the opposite side directly by a corresponding design of the tube ends.

Various embodiments which achieve a tight separation between the flow tanks in the area of the bottom 12 will now be described.

Figure 3:
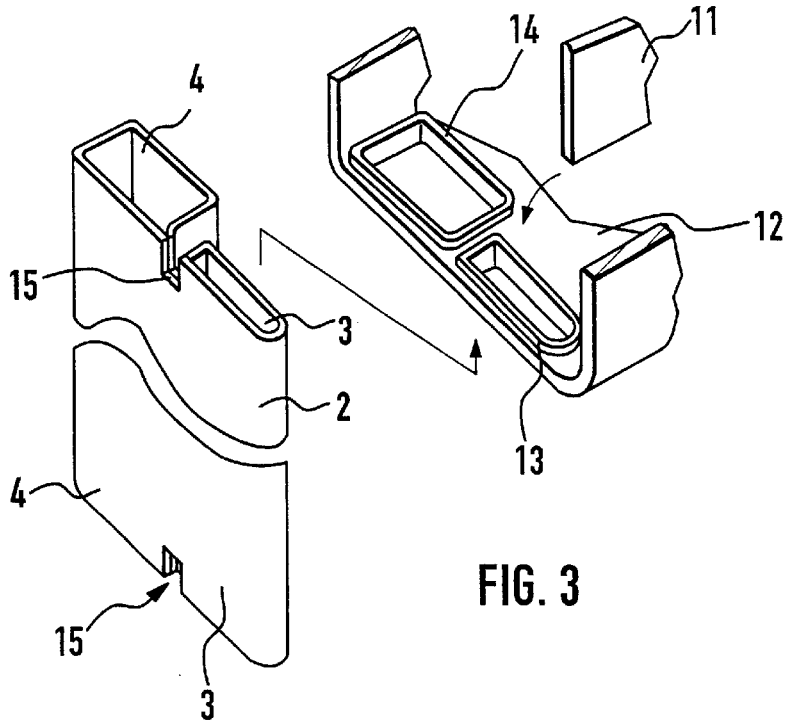
FIG. 3 is an enlarged perspective exploded view of the arrangement of a multi-chamber tube in a passage of a floor of a flow tank unit of the heat exchanger arrangement according to FIG. 2.

In the embodiment shown in FIG. 3, each of the opposite front ends of the multi-chamber tubes 2 is provided, at the level of the separating section between the chamber sections 3, 4, with one respective recess 15 which is open on the front side 3. The recess has a width which is coordinated with a separating web remaining between the passage sections 13, 14 of the bottom 12. The separating web between the two passage sections 13, 14 is designed on the interior side and thus on the side opposite the multi-chamber tubes 2 such that a separating wall 11 for dividing the two flow tanks can be fitted between the adjacent edges of the passage sections 13, 14 and flush onto the bottom 12. A tight brazed connection is provided, because of braze plating on sides of all components of the heat exchanger arrangement, by brazing in a brazing furnace after a corresponding preassembly has been achieved by fitting the various components together.

Figure 4:
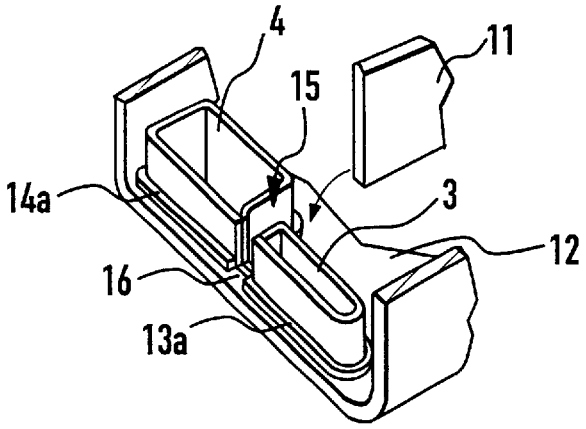
FIG. 4 is a view of a cutout of a connection between a multi-chamber tube and a bottom of a flow tank unit similar to FIG. 3.
Figure 6:
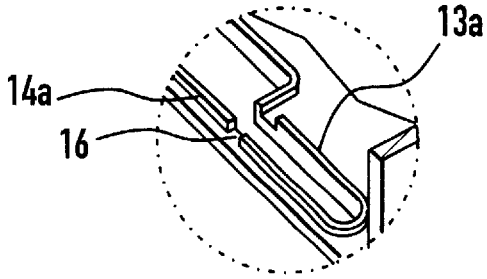
FIG. 6 is a view of an enlarged cutout of the passage of the bottom shown in FIG. 4.

In the embodiment shown in FIGS. 4 and 6, a continuous passage for the multi-chamber tube is provided in the area of the bottom 12. In the area of corresponding passage sections 13*a*, 14*a*, the bottom is adapted to the outer contour of each of the chamber sections 3, 4. The separating wall 11 is fitted precisely into the recesses 15 of the multi-chamber tubes, and the passages in the area of the seat of the separating wall 11 are recessed by cutouts 16 (FIG. 6). As a result, the separating wall 11 can have a continuous plane lower edge which is disposed on the bottom 12 in a flush manner.

Figure 5:
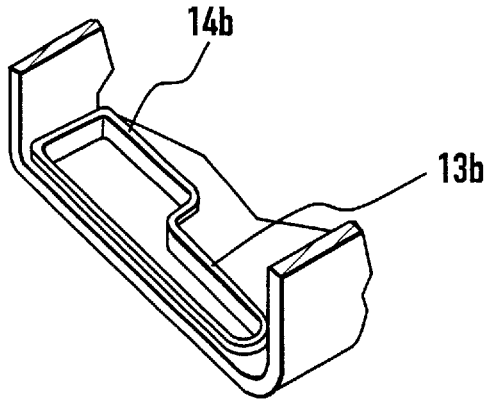
FIG. 5 is an enlarged perspective view of a floor of a flow tank unit for a heat exchanger provided with a passage.
Figure 7:
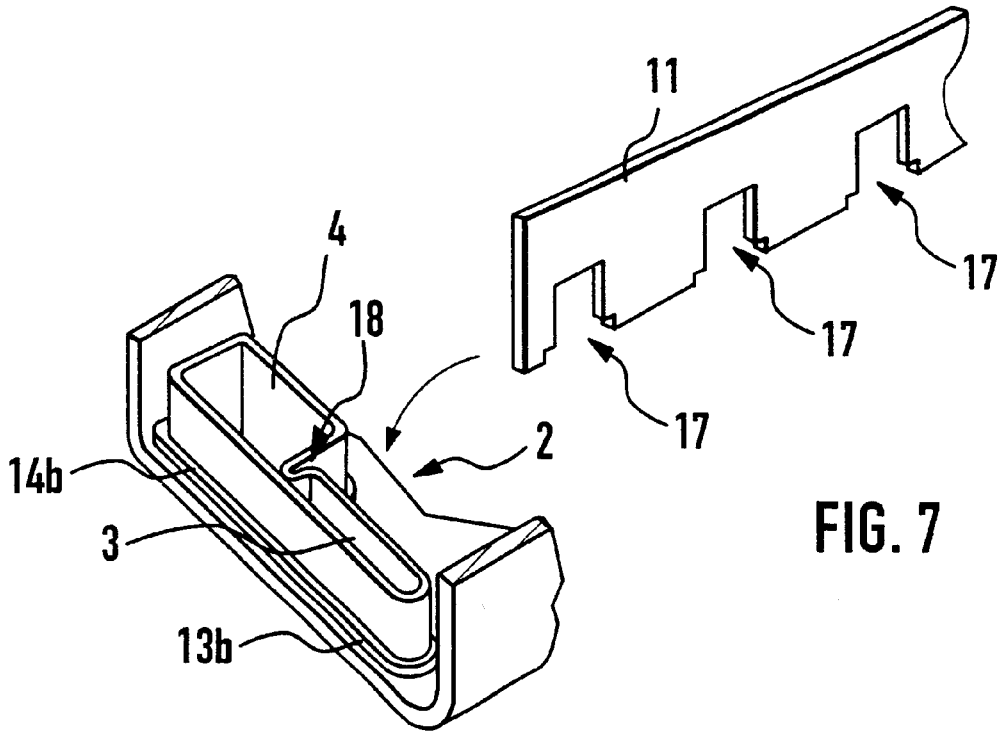
FIG. 7 is another view of the connection of a multi-chamber tube with a bottom of a flow tank unit with a bottom passage as shown in FIG. 5.

In the embodiment shown in FIG. 5, a surrounding passage 13*b*, 14*b* is provided which has no cutouts in the inwardly drawn, surrounding edge area. According to FIG. 7, multi-chamber tubes 2 can be fitted into such passages; these multi-chamber tubes 2 are provided with a separating section 18 or with separating sections 5*a* to 5*h* as shown in FIGS. 1*a* to 1*h* continuously to the front ends. By way of its passage sections 13*b*, 14*b*, each passage rests continuously tightly against the outer contour of the multi-chamber tube 2. In order to achieve a placement of the separating wall 11 which is flush with the bottom, the separating wall 11 is provided, in the area of the separating sections 18 at the level of each multi-chamber tube 2, with recesses 17 which, in addition, are coordinated with the inwardly drawn passages 13*b*, 14*b*.

Figure 8:
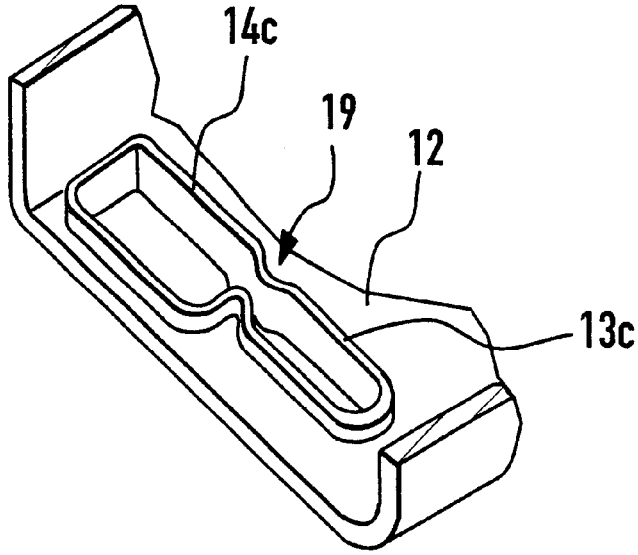
FIG. 8 is a view of a floor of a flow tank unit of a heat exchanger, with another passage, similar to FIG. 5.
Figure 9:
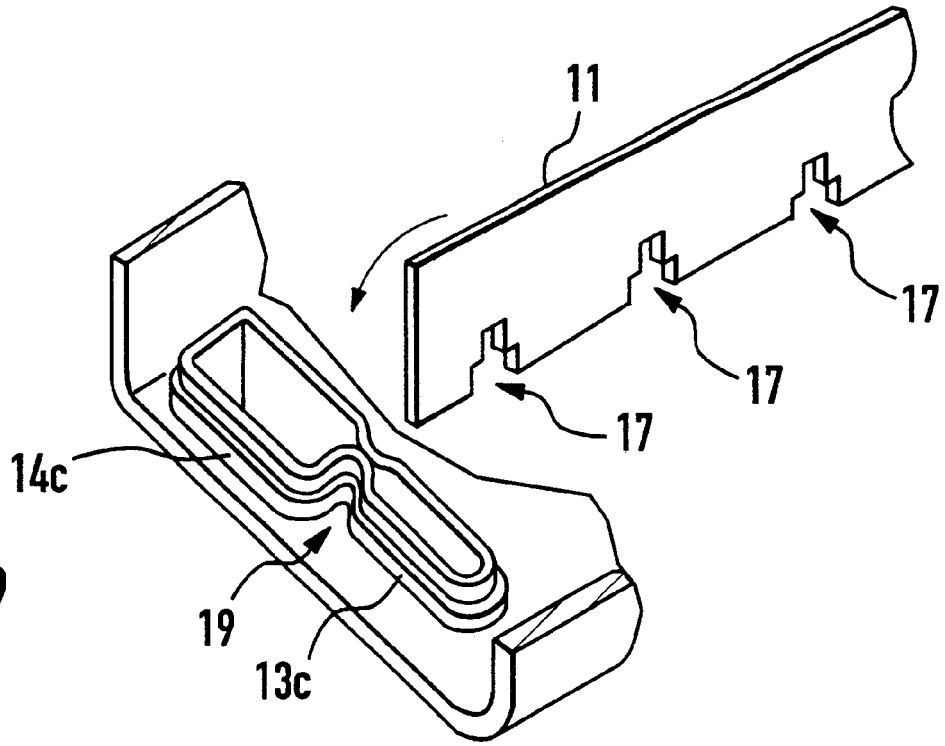
FIG. 9 is a perspective view of the connection of a multi-chamber tube with the floor of FIG. 8.

In the embodiment shown in FIGS. 8 and 9, the bottom 12 is provided with several passages 13*c*, 14*c*. For reasons of simplicity, FIG. 8 only shows a single passage 13*c*, l4*c*. The surrounding edge of each passage 13*c*, 14*c* is provided, at the level of the separating section of the matching multi-chamber tube, with inward-extending indentations 19. The indentations are coordinated with the corresponding depressions of the multi-chamber tube (FIG. 2) to be pushed in. The separating wall 11 is again provided with recesses 17 which ensure that the separating wall is placed flush on the bottom 12 of the flow tanks.

Figure 10:
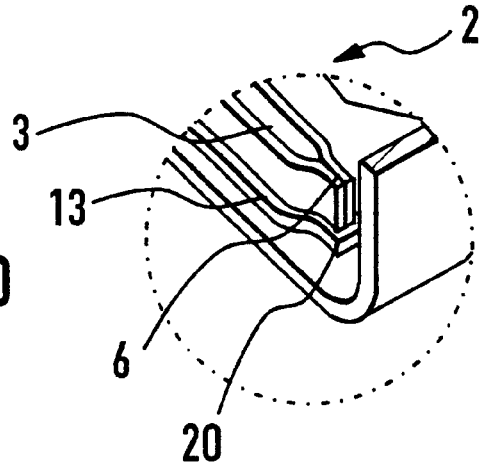
FIG. 10 is a view of a cutout of another tube/bottom connection with the multi-chamber tube being having a web flange.

In a bottom area cutout of a heat exchanger arrangement similar to FIG. 2 according to FIG. 10, the respective passage 13 is provided with an additionally attached passage continuation 20 which is coordinated with a web flange 6 of a multi-chamber tube according to FIGS. 1*a*, 1*b*, 1*d*, and 1*f*.

Similar to the two separated fin arrangements shown in FIG. 2, in the fin/tube blocks of heat exchanger arrangements which are schematically illustrated in FIGS. 11 and 12, differently designed fin arrangements 21, 22 are assigned to the multi-chamber tubes 2. Each of these tubes is composed of two chamber sections 3, 4. The fin arrangements are divided into one corrugated fin arrangement 21 and one web fin arrangement 22, respectively. The width of each fin arrangement extending between the multi-chamber tubes 2 differs analogously to the different heights of the chamber sections 3, 4 in that the corrugated fin arrangement 21 has a wider design than the web fin arrangement 22. In the embodiment shown in FIG. 11, the fin arrangements are also designed, in a way similar to the mirror-symmetrical design of the multi-chamber tubes, mirror-symmetrically with respect to a longitudinal center plane. In contrast, in the embodiment shown in FIG. 12, in a way similar to the asymmetrical design of the multi-chamber tubes 2, an asymmetrical design of the fin arrangements 21*a*, 22*a* is also provided. Also, in this embodiment, each fin arrangement is formed either by a corrugated fin arrangement 21*a* or by a web fin arrangement 22*a*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Heat exchanger arrangement for a motor vehicle comprising a fin/tube block with a plurality of multi-chamber tubes, each multi-chamber tube comprising at least two chamber sections which extend parallel to each other and side-by-side and having widths which are significantly greater than their heights, one of said sections provided to guide one liquid or gaseous heat transfer medium and another of said sections provided to guide a different liquid or gaseous heat transfer medium, wherein at least one of said chamber sections has a greater height than at least one other of said chamber sections, and flow tank units on opposite sides of said fin/tube block into which opposite ends of said chamber sections lead.

2. Heat exchanger arrangement according to claim 1, wherein the multi-chamber tube is formed of a metal sheet which is plated by brazing on both sides.

3. Heat exchanger arrangement according to claim 2, wherein, in at least one of said chamber sections, several ducts are integrated which extend parallel to one another.

4. Heat exchanger arrangement according to claim 1, wherein separating and edge sections are formed by material-locking connections.

5. Heat exchanger arrangement according to claim 4, wherein said material-locking connections are brazed connections.

6. Heat exchanger arrangement according to claim 4, wherein said material-locking connections are welded connections.

7. Heat exchange arrangement according to claim 1, wherein each of said chamber sections has a height which remains the same over its width.

8. Heat exchanger arrangement for a motor vehicle having at least two heat exchangers which have a common fin/tube block with a plurality of multi-chamber tubes as well as a plurality of fin arrangements, each of the multi-chamber tubes comprising at least two chamber sections which extend parallel to each other and side-by-side and having widths which are significantly greater than their heights, one of said sections provided to guide one liquid or gaseous heat transfer medium and another of said sections provided to guide a different liquid or gaseous heat transfer medium, wherein at least one of said chamber sections has a greater height than at least one other of said chamber sections, and flow tank units on opposite sides of said common fin/tube block into which opposite ends of said chamber sections lead.

9. Heat exchanger arrangement according to claim 8, wherein each fin arrangement is a corrugated or web fin arrangement.

10. Heat exchanger arrangement according to claim 8, wherein at least one of the flow tank units has a common bottom continuous over the width of the multi-chamber tubes, and wherein said bottom is provided with passages adapted to different cross-sections of the chamber sections.

11. Heat exchanger arrangement according to claim 10, wherein each of said multi-chamber tubes has an individual surrounding passage, which has a width corresponding to the height of the chamber sections, assigned thereto.

12. Heat exchanger arrangement according to claim 10, wherein separated passage sections, which correspond in number to the chamber sections, are assigned to each multi-chamber tube, and wherein each free cross-section of said passage sections is adapted to an outer contour of one of the chamber sections.

13. Heat exchanger arrangement according to claim 12, wherein each of the multi-chamber tubes is provided, in the area of the bottom of the at least one of the flow tank units, with one recess, open on the front side, between adjacent chamber sections, the recess being adapted to a separating web remaining between the passages of the common bottom.

14. Heat exchanger arrangement according to claim 10, wherein the at least one of the flow tank units has at least two flow tanks provided with at least one separating wall extending between the flow tanks and between the chamber sections.

15. Heat exchanger arrangement according to claim 14, wherein the separating wall is provided, at a level of the multi-chamber tubes, with recesses for the flush fitting-on of the separating wall onto the multi-chamber tubes and the passages.

16. Heat exchanger arrangement according to claim 14, wherein the at least one of the flow tank units, including the bottom and the separating wall, is formed in one piece from a single sheet metal blank.

17. Heat exchanger arrangement according to claim 8, wherein each of said chamber sections has a height which remains the same over its width.

* * * * *